United States Patent [19]

Keyes, IV et al.

[11] Patent Number: 4,575,334

[45] Date of Patent: Mar. 11, 1986

[54] LOSS MINIMIZATION COMBUSTION CONTROL SYSTEM

[75] Inventors: Marion A. Keyes, IV, Chagrin Falls; Michael P. Lukas, Eastlake; Robert E. Pocock, Highland Heights, all of Ohio

[73] Assignee: The Babcock & Wilcox Company, New Orleans, La.

[21] Appl. No.: 550,439

[22] Filed: Nov. 14, 1984

Related U.S. Application Data

[62] Division of Ser. No. 438,216, Nov. 1, 1982.

[51] Int. Cl.[4] ..... F23N 5/00

[52] U.S. Cl. ..... 431/76; 431/79; 236/15 E

[58] Field of Search ..... 431/12, 76, 79; 236/15 E; 340/578

[56] References Cited

U.S. PATENT DOCUMENTS

| | | | |
|---|---|---|---|
| 3,723,047 | 3/1973 | Baudelet de Livois | 431/76 |
| 4,360,336 | 11/1982 | Shepherd | 431/76 X |
| 4,362,499 | 12/1982 | Nethery | 431/76 X |

*Primary Examiner*—Randall L. Green

*Attorney, Agent, or Firm*—Vytas R. Matas; Robert J. Edwards

[57] ABSTRACT

A system for minimizing combustion operation losses includes measuring a load index for the combustion operation which is proportional to the fuel demand or the output thereof, measuring an amount proportional to the air heating losses of the combustion operation and measuring an amount which is proportional to the fuel loss of the operation. The air heating loss is measured by multiplying a flue temperature by an amount of unburned oxygen in the flue gas. This quantity is multiplied by a cost factor for such air heating and the load index. The fuel loss is obtained by measuring an amount of by-product in the flue gas as well as the opacity of the flue gas. These are multiplied by appropriate cost factors which in the case of opacity is proportional to a fine that would be due for violating certain limits for the opacity. Minimum values are found for the fuel loss and air heating loss quantities, as air demand to the combustion operation is changed. A minimum for the sum of the fuel and air heating losses is also obtained with the air demand of the combustion operation being set so that all of the losses are as low as possible. In this way the costs of undesired air heating, unburned by-products as well as potential violation of flue gas characteristic limits are utilized in determining the most economical air demand for the combustion operation.

1 Claim, 3 Drawing Figures

LOSS MINIMIZATION COMBUSTION CONTROL SYSTEM

This is a division of application Ser. No. 438,216, filed Nov. 1, 1982.

FIELD AND BACKGROUND OF THE INVENTION

The present invention relates to the control of a combustion process in a boiler, heater, or other device in which fuel and air are combined and burned to produce heat.

Techniques are known in the area of combustion control which involve the measurement of various products of combustion in the flue gases and the use of these measurements to adjust the amount of excess air (or air/fuel ratio) supplied beyond the stoichiometric level required for ideal combustion. The prior art recognizes that there is a tradeoff between a high level of excess air, in which air heating losses predominate, and too low a level of excess air, in which unburned fuel losses predominate.

Prior approaches to optimizing the combustion process fall into one of three categories, depending on what product or products of combustion are being measured in the flue gases: oxygen only, combustibles only, or a combination of the two. These are discussed separately in the following.

The oxygen only approach is used in the Bailey Meter Company U.S. Pat. No. 3,049,300, "Combustion Control for a Furnace Fired With Fuels Having Different Oxygen-Excess Air Characteristics," dated Aug. 14, 1962. An analyzer is used to measure the oxygen in the flue gas, and the excess air is reduced until the measured oxygen reaches a preselected set point.

The combustibles only (Carbon monoxide-CO, hydrocarbons, and/or opacity) approach is used in Standard Oil Company (Indiana) U.S. Pat. No. 4,260,363, "Furnace Fuel Optimizer," dated Apr. 7, 1981, and the copending application to the Econics Corporation, referenced in a technical paper by Keith Swanson, "An Advanced Combustion Control System Using Distributed Microcomputer Techniques," ISA Publication ISBN 0-87664-521-X, 1981. An analyzer or analyzers are used to measure one or more of these parameters, and excess air is adjusted until they reach a preselected set point. If more than one variable is measured and controlled, some switching between controlled variables is done to attain the most "conservative" value of excess air.

The combination of oxygen and combustibles approach is used in the Measurex Corporation U.S. Pat. No. 4,162,889, "Method and Apparatus for Control of Efficiency of Combustion in a Furnace," dated July 31, 1979, and Westinghouse Electric Corporation U.S. Pat. No. 4,231,733, "Combined O2/Combustibles Solid Electrolyte Gas Monitoring Device," dated Nov. 4, 1980 and a copending application to the Bailey Controls Company, "A System for CO and O2 Control of Combustion Processes." In this case, both oxygen and combustibles are measured. In Measurex patent and the copending application, the deviation of CO from its preselected set point is used to adjust the set point of an O2 controller in a cascade fashion. In the Westinghouse Patent, excess air is adjusted to control, to a preselected combustibles set point, until the oxygen moves outside preselected limits. Then the control mode is switched to bring the oxygen back within limits, at which point combustibles control is resumed.

The shortcomings of the current aproaches to combustion control are as follows:

All of the approaches attempt to control to arbitrary selected set points one or more of the products of combustion. There is no guarantee that combustion conditions are such that these set points can be reached or that these set points are the best ones from an economic point of view however.

In approaches that attempt to switch among multiple variables to be controlled, it is likely that limit cycling will occur as the various switch points are reached and the modes of control change. This leads to undesirable cyclic stresses on the process equipment.

None of the approaches attempts to directly minimize any explicit measure of economic loss, such as the cost of unburned fuel up the stack, the cost of heating the excess air, or the cost of violating government emission regulations.

SUMMARY OF THE INVENTION

The present invention differs from and improves upon the prior art in the following respects:

(1) The combustion control approach is based explicitly on minimizing a penalty function that represents the sum of economic losses in running the combustion process.

(2) The control approach does not rely on selecting a set point for any one product of combustion parameter (e.g., CO, oxygen, or opacity) that may or may not be the best one under current operating conditions.

(3) The control approach takes into account the economic penalty of not meeting governmental emission regulations.

The basic concept behind the present invention involves measurements of excess air and of each of the combustibles elements. These are multiplied by a boiler/heater load index to produce a "rate of loss" estimate for each element. These rates are multiplied by appropriate economic factors to convert them into the "dollars lost" per unit time of operation, then added together to produce a combined loss index. The air/fuel ratio then is adjusted during on-line operation to search for the minimum value of this loss index. The economic impact of violating Environmental Protection Agency (EPA) regulations on smoke emissions is taken into account by significantly increasing the rate of penalizing the opacity component as it approaches the EPA limit.

Accordingly, an object of the present invention is to provide a method of reducing losses in a combustion operation for burning fuel with air at a load level with the combustion operation producing flue gas having unburned by-product and oxygen and being at a stack temperature, comprising, measuring a load index for the combustion operation which is proportional to the load level thereof, measuring an air heating loss for the combustion operation which is proportional to the stack temperature, an amount of excess oxygen in the flue gas, a load index, and a cost factor for air heating, measuring an unburned by-product loss for the combustion operation which is proportional to an amount of unburned by-product in the flue gas, the load index and a cost factor for the unburned by-product, measuring a characteristic loss for the combustion operation which is proportional to a characteristic of the flue gas (e.g., opacity), the load index and a cost factor for that characteristic (e.g., a fine exacted for exceeding set limits for that characteristic), adding the unburned by-product loss to the characteristic loss to obtain a total fuel loss for the operation, varying air demand to the combustion operation to obtain different values of the air heating loss, the fuel loss, and a summation of the air heating and fuel losses, and selecting an air demand point for the combustion operation at which the summation of air heating and fuel losses is as low as possible for a selected load level. The air demand signal is then sent to and operates in conjunction with the fuel portion of the combustion control system.

Another object of the invention is to provide an apparatus for reducing losses in a combustion operation.

A still further object of the invention is to provide such an apparatus which is simple in design, rugged in construction, and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

DESCRIPTION OF THE PREFERRED EMBODIMENT

Figure 1:
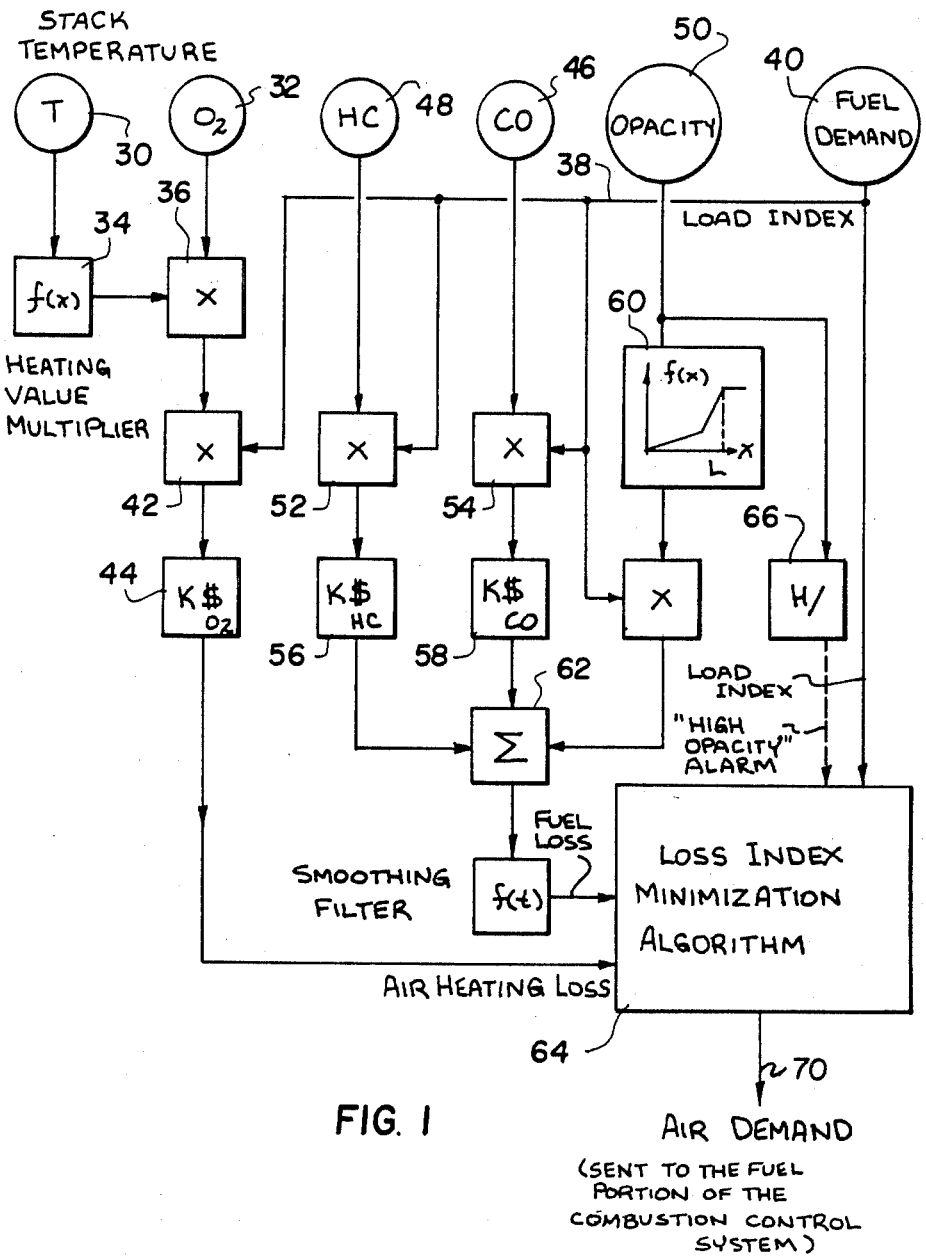
FIG. 1 is a block diagram of an apparatus for minimizing loss in a combustion operation in accordance with the invention.
Figure 2:
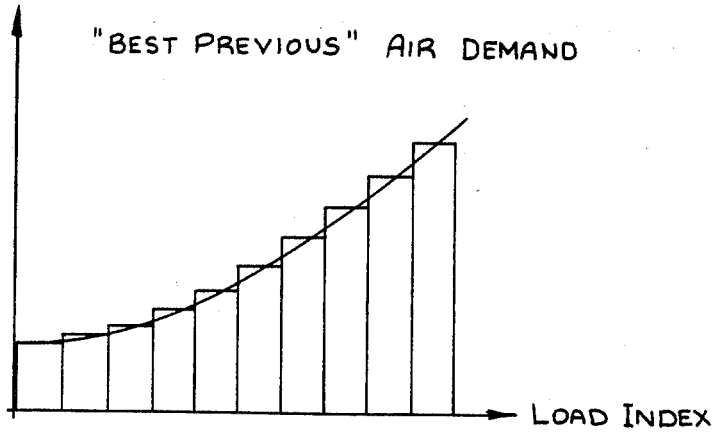
FIG. 2 is a graph plotting the best previous air demand against a load index for the combustion operation.
Figure 3:
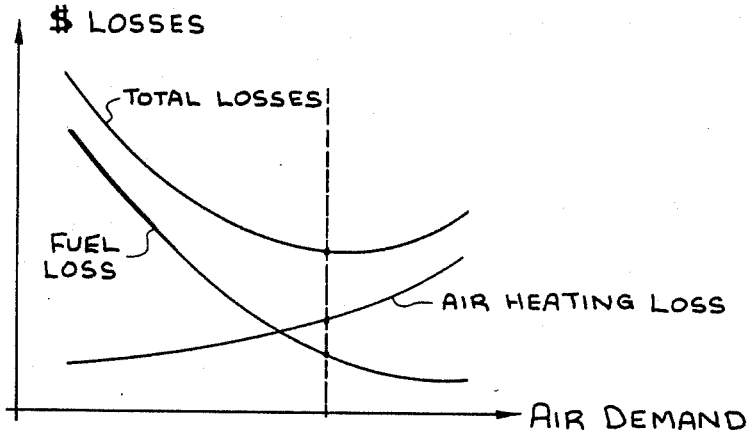
FIG. 3 is a graph plotting the cost in dollars against the air demand which reflects the various losses in the combustion operation.

One embodiment of the present invention is illustrated in FIGS. 1 through 3. In this embodiment, the cost of heating the excess air is estimated by using measurements of the stack temperature from transmitter 30 and oxygen from transmitter 32 in the flue gas. A function generator 34 and multiplier 36 converts these measurements into an effective heat value of the excess air. This value is multiplied by the boiler/heater load index provided in line 38. In this case this value is fuel demand as measured in fuel demand transmitter 40. It could also be steam flow in a boiler or product flow in a process heater. Multiplier 42, thus, generates a heat loss rate, which is then multiplied by a K$ factor to convert the loss rate into the air heating loss per unit time in dollars, in a multiplier 44.

On the combustibles side, measurements are made in transmitters 46, 48, and 50 of carbon monoxide (CO), hydrocarbons (HC), and opacity. The CO and HC measurements are multiplied by the load index and the K$ factors in multipliers 52, 54, 56, and 58, to generate a fuel loss rate per unit time. The opacity measurement is handled in the same way, except that a function generator 60 is used instead of a simple K$ multiplication factor. The function generator sharply increases the effective K$ factor when the opacity approaches the allowed EPA limit L, then settles out at the magnitude of the fine when the limit is reached or exceeded. All of the combustibles loss rates then are added together in a summing unit 62 and smoothed (filtered in time) to generate a total fuel loss rate in dollars per unit time. Summing unit 62, thus, generates a total of the unburned by-product loss and loss due to a characteristic of the flue gas (opacity) which may cause a fine.

The air and fuel loss rates are fed into the "Loss Index Minimization Algorithm" block 64 shown in FIG. 1. A "high opacity alarm" is generated when the opacity exceeds the EPA limit by a limit and alarm unit 66. This alarm and the load index are also fed into the minimization algorithm block 64. Air demand is set by an optimum air demand value provided on line 70 from block 64.

The operation of the "Loss Index Minimization Algorithm" block 64 is illustrated in FIGS. 2 and 3. The block keeps track of the "best previous" values of air demand that have been found for each value of load index (FIG. 2). Also, the corresponding dollar values of air heating loss, fuel loss, and total loss (the sum of the other two losses) are stored for each load index value (FIG. 3). Under normal operating conditions (defined as occurring when the high opacity alarm is not active and the boiler/heater load is not changing), the minimization algorithm then searches for the minimum value of the total loss parameter by adjusting the air demand output from the block. The algorithm increases or decreases the air demand, depending on the deviation of the current values of air and fuel losses from the corresponding "best previous" values stored. That is, if the fuel loss parameter is near its previous "best value" but the air loss is significantly higher, the algorithm will reduce the air demand. On the other hand, if the deviation in fuel losses predominates compared to the previous best values, the algorithm will increase the air demand. After waiting for a period of time equal to the time lag of the process, the algorithm then measures the new value of the total loss parameter. If it is less than the stored "best previous" value for the current load index, the new air demand replaces the old one as the "best previous" value. Also, the corresponding new loss parameters then replace the old ones and the search continues incrementally in the same direction until a minimum is found as shown at M in FIG. 3.

The optimization algorithm operates as described only under "normal" operating conditions as defined above. If the load index is changing, the optimization operation is suspended and the air demand output is adjusted to match the "best previous" value stored for the current load index. If the load index is stable but the "high opacity" alarm is active, the loss minimization operation still continues, but the "best previous" air demand and loss values found under these alarm conditions are discarded after the alarm becomes inactive. This is done because the fuel loss parameter is made artificially high during these alarm conditions; therefore, its value is not relevant under normal operating conditions.

While a specific embodiment of the invention has been shown and described in detail to illustrate the application of the principles of the invention, it will be understood that the invention may be embodied otherwise without departing from such principles.

What is claimed is:

1. An apparatus for reducing losses in a combustion operation for burning fuel with air at a low level with the combustion operation producing flue gas having unburned by-product, oxygen and a selected stack temperature, comprising:

a temperature transmitter for measuring the stack temperature;

an oxygen sensor for sensing unburned oxygen in the flue gas;

at least one unburned combustion by-product sensor for sensing an amount of unburned combustion by-product in the flue gas;

an opacity sensor for sensing the opacity of the flue gas;

means for establishing a load level for the combustion operation which is proportional to a load index thereof;

a first multiplier connected to the temperature transmitter and oxygen sensor for multiplying values generated thereby together;

a second multiplier connected between said means and an output of said first multiplier for multiplying values generated thereby together;

a first cost factor unit connected to an output of said second multiplier for generating an air heating loss value in response to said second multiplier output;

a third multiplier connected between said means and said at least one unburned by-product sensor for multiplying values generated thereby together;

a second cost factor unit connected to an output of said third multiplier for generating a quantity value proportional to an unburned by-product loss for the combustion operation in response to said third multiplier output;

a function generator connected to an output of said opacity sensor for multiplying an amount of opacity sensed by said opacity sensor by an amount which increases to a fine that is exacted for reaching a limit in opacity; a fourth multiplier connected to an output of said function generator and to said means for multiplying values generated thereby together for generating an opacity loss quantity value;

a summing unit connected to an output of said second cost factor unit and said fourth multiplier for combining values generated thereby together for generating a total fuel loss value for the combustion operation; and a loss index minimizing unit connected to an output of said summing unit, an output of said first cost factor unit, and to said means, for generating an air demand signal for controlling the amount of air for the combustion operation, at which a fuel loss cost, an air heating loss cost, and a summation of fuel loss cost plus air heating loss cost are minimized.

* * * * *